US006089075A

United States Patent [19]

Bramblett

[11] Patent Number: 6,089,075

[45] Date of Patent: Jul. 18, 2000

[54] HOOK BAR TOOL FOR BUMPER REPAIR

[75] Inventor: Jeff Bramblett, Dallas, Tex.

[73] Assignee: Bumper Man, Inc., Dallas, Tex.

[21] Appl. No.: 09/287,554

[22] Filed: Apr. 5, 1999

[51] Int. Cl.[7] ..... B21S 13/08

[52] U.S. Cl. ..... 72/458; 72/705; 254/130; 254/131

[58] Field of Search ..... 72/457, 458, 459, 72/705; 254/120, 129, 130, 131

[56] References Cited

U.S. PATENT DOCUMENTS

| | | | |
|---|---|---|---|
| 236,683 | 1/1881 | Leyburn . | |
| 391,801 | 10/1888 | Kirkland . | |
| 927,653 | 7/1909 | Heckman . | |
| 1,324,693 | 12/1919 | Rush . | |
| 1,344,562 | 6/1920 | Probasco . | |
| 1,427,299 | 8/1922 | Kennedy . | |
| 1,479,741 | 1/1924 | Reitz . | |
| 1,581,119 | 4/1926 | Herring . | |
| 1,616,653 | 2/1927 | Frasier et al. . | |
| 1,676,263 | 7/1928 | Hawkins . | |
| 1,754,994 | 4/1930 | Ferguson . | |
| 1,785,923 | 12/1930 | Wade . | |
| 1,815,180 | 7/1931 | Bennett . | |
| 1,850,073 | 3/1932 | Countryman . | |
| 1,879,583 | 9/1932 | Stowell . | |
| 1,889,187 | 11/1932 | Wochner . | |
| 2,010,713 | 8/1935 | Countryman | 153/32 |
| 2,140,686 | 12/1938 | Bennett | 153/32 |
| 2,165,503 | 7/1939 | Pfauser | 153/32 |
| 2,165,504 | 7/1939 | Pfauser | 153/32 |
| 2,191,720 | 2/1940 | Meinhardt | 81/15 |
| 2,194,991 | 3/1940 | Voges | 153/32 |
| 2,255,987 | 9/1941 | Schultz | 153/48 |
| 2,340,587 | 2/1944 | Graham | 153/32 |
| 2,442,604 | 6/1948 | Johnson et al. | 153/39 |
| 2,446,487 | 8/1948 | O'Kelley | 153/51 |
| 2,597,103 | 5/1952 | Johnson et al. | 153/39 |
| 2,597,234 | 5/1952 | Elam | 153/39 |
| 2,616,317 | 11/1952 | Skakkerup | 72/458 |
| 2,757,705 | 8/1956 | Johnson | 153/39 |
| 2,771,933 | 11/1956 | Edwards | 153/32 |
| 2,776,587 | 1/1957 | Killius | 72/705 |
| 2,794,355 | 6/1957 | Geller | 72/458 |
| 2,836,219 | 5/1958 | Pertner | 153/32 |
| 2,836,220 | 5/1958 | Johnson | 153/39 |
| 2,863,489 | 12/1958 | Priest | 153/38 |
| 2,938,412 | 5/1960 | Walker | 81/15 |
| 2,938,413 | 5/1960 | Pauls | 81/15 |
| 2,979,102 | 4/1961 | Ferguson et al. | 153/39 |
| 2,998,837 | 9/1961 | Luedicke, Jr. et al. | 153/32 |
| 3,027,930 | 4/1962 | Padgett | 153/32 |
| 3,029,859 | 4/1962 | Grant | 153/32 |
| 3,034,563 | 5/1962 | Gaspar et al. | 153/32 |
| 3,034,564 | 5/1962 | Cavazos | 153/32 |
| 3,036,623 | 5/1962 | Hanak | 153/32 |

(List continued on next page.)

FOREIGN PATENT DOCUMENTS

| | | | |
|---|---|---|---|
| 710438 | 6/1954 | United Kingdom | 72/705 |

OTHER PUBLICATIONS

Steck, "Autobody and Specialty Tools", 1986.

*Primary Examiner*—Ed Tolan
*Attorney, Agent, or Firm*—Smith & Danamraj, P.C.

[57] ABSTRACT

A manually usable bumper repair tool formed of a steel shank with a first hook end and a second hook end, each of which hook ends curves to a thin edge adapted for prying underneath and clasping a portion of a bumper or other sheet metal structure. The steel shank is provided with one or more apertures for engaging a lever bar of suitable length. One of the thin edges is placed under a portion of a bumper surface and the lever bar is positioned through one of the apertures. For exerting maximum force, apertures distally disposed from the engaged hook end may be used. Using a wall of the aperture as the fulcrum, by rotatably and pivotally applying a force on the lever bar, a linear or angular force may be applied at the work surface so that the structure is straightened, or pulled or pushed into its original design shape.

10 Claims, 3 Drawing Sheets

U.S. PATENT DOCUMENTS

| | | | |
|---|---|---|---|
| 3,050,099 | 8/1962 | Smith | 153/32 |
| 3,066,719 | 12/1962 | Selnick | 153/32 |
| 3,149,659 | 9/1964 | Boget, Jr. | 153/32 |
| 3,149,660 | 9/1964 | Smith | 153/32 |
| 3,206,966 | 9/1965 | Fagan et al. | 72/295 |
| 3,340,720 | 9/1967 | Chartier | 72/389 |
| 3,398,565 | 8/1968 | Whitney | 72/453 |
| 3,457,767 | 7/1969 | Surber | 72/446 |
| 3,459,018 | 8/1969 | Miller | 72/7 |
| 3,492,855 | 2/1970 | Wylie | 72/447 |
| 3,581,547 | 6/1971 | Estigarribia | 72/453 |
| 3,753,368 | 8/1973 | Lang | 72/475 |
| 3,906,777 | 9/1975 | Dickens | 72/447 |
| 4,120,256 | 10/1978 | Semler | 113/57 |
| 4,934,174 | 6/1990 | Gronlund et al. | 72/458 |
| 5,295,384 | 3/1994 | Schubert | 72/389 |
| 5,394,729 | 3/1995 | Eisenhower, Jr. | 72/458 |
| 5,461,900 | 10/1995 | Gutierrez | 72/479 |
| 5,626,045 | 5/1997 | Bulle | 72/219 |

HOOK BAR TOOL FOR BUMPER REPAIR

BACKGROUND OF THE INVENTION

1. Technical Field of the Invention

This invention relates to tools for repairing bumpers and other sheet metal automobile body parts such as fenders. More particularly, this invention relates to a hook bar tool that is manually operable for repairing bumpers, sheet metal structures and the like.

2. Description of Related Art

It has traditionally been common practice to repair damaged automobile bumpers by hammering them into a shape that approximates their original shape as much as possible. This technique is tiresome and time consuming, and the results are typically unsatisfactory, especially with bumpers of recent design that have complex curvatures.

A more recent technique is to use a press, usually hydraulically powered, in which the bumper to be repaired is pressed between a moving portion, referred to as and resembling a blade, and a fixed portion, called the plate, cross bars or anvil. The blade is attached to the moving shaft of the press, and is caused to repeatedly approach the anvil and squeeze dents and distortions from the bumper while the position of the bumper on the anvil is repeatedly readjusted. Those of ordinary skill in the art shall realize that this method is, of course, simply a power-driven improvement over the manual hammering approach, and suffers from similar disadvantages, especially in that the resulting repaired bumper is typically not at all like a new one because the curves cannot be smoothly restored by the "blade press" technique.

It is well recognized that the most desirable bumper repair tools may include dies somewhat like those originally used to produce the bumpers. However, these production dies are designed and constructed to form a bumper from a substantially flat metal sheet. Accordingly, they are made of steel and formed by the use of expensive precision tools and die-making techniques. Moreover, it should be realized that such repair work is not cost-effective for a bumper repair shop that needs to service a large number of damaged bumpers at an affordable price.

Also, it is necessary for a bumper repair shop to maintain the ability to repair bumpers for nearly any model of automobile for at least a few model years. Quite clearly, it would be prohibitively expensive for a bumper shop to obtain and stock dies of that type set forth above for each bumper style to be repaired.

Although not quite as effective as the precision dies, certain hand tools have been developed in the past for the purpose of providing cost-effective automotive body repair. These hand tools operate by bending sheet metal edges. While certainly economical and easy to use, these commonly used hand tools are prone to cause unwanted denting and scratching of metal surfaces. Nor are they usable with a variety of bumper styles, ranging from those on light trucks to bumpers on passenger cars.

It should be readily apparent to one of ordinary skill in the art that the traditional bumper repair tools described above are not very effective or useful in some situations. For example, where a bumper is grossly bent or deformed, it may be necessary to pull the bumper into a shape that approximates the original design shape. Also, in some accidents, it is possible for an automobile bumper to be pushed up against or tilted away from the vehicle such that it requires a straightening or realigning of the bumper part by exerting sufficient linear or angular force. Moreover, it may be required in some circumstances that such bumper repair be accomplished by a single individual. Accordingly, it may be necessary for the bumper repair tool to be adjustable or re-adjustable so that repairmen of different size and strength can exert sufficient force in the proper direction for effectuating the bumper repair. In these instances, the use of traditional tools is typically neither cost-effective nor appropriate.

Based upon the foregoing discussion, it should be readily appreciated that there exists an acute need for a bumper repair tool that overcomes the deficiencies and shortcomings of the existing solutions described hereinabove by providing a simple, easy to use tool that is operable preferably by an individual user without involving any power-driven machinery. Further, it is preferably required that such tool system be cost-effective to manufacture and economical to use for bumper straightening, pulling, pushing or realigning. The present invention provides such an advantageous solution.

SUMMARY OF THE INVENTION

In one aspect, the present invention is directed to a bumper repair tool operable with a lever bar. The bumper repair tool preferably comprises a shank with a first hook end and a second hook end, wherein the shank is made of a suitable grade of stiff material (for example, spring steel) formed in a substantially rectangular cross-section. The shank tapers in both its thickness and width towards each of the first and second hook ends, thereby forming a first neck and a second neck thereat, respectively. The shank includes a plurality of apertures formed therein. Preferably, the apertures are aligned along a longitudinal axis of the shank, and are dimensioned to receive and allow passage of the level bar therethrough.

The first hook end tapers to a first thin edge, curving over the first neck at a first radius of curvature. Preferably, the second hook end also tapers to a second thin edge curving over the second neck at a second radius of curvature. The first and second thin edges are adapted for prying under a bumper surface such that at least one of the first and second hook ends is removably and pivotally engagable at the bumper surface. The first hook end preferably includes a pair of opposing notches formed thereat, wherein one of the notches is disposed on a first side of the first hook end and the other notch is disposed on a second side of the first hook end. Preferably, the second hook end also includes a pair of opposing notches formed thereat, similar to those disposed at the first hook end. That is, one of the notches is disposed on a first side of the second hook end and the other notch is disposed on a second side of the second hook end.

In another aspect, the present invention is directed to a manually operable repair tool system which comprises a lever bar of a suitable length, and a hook bar with a shank having a first hook end and at least one aperture dimensioned to receive and engage the lever bar. The first hook end curves approximately 180° at a first radius of curvature to a thin edge adapted to clasp around a portion of a metal sheet. The level bar is positioned through the aperture such that it is pivotally rotatable when the first hook end is engaged with the metal sheet portion.

In a yet further aspect, the present invention is drawn to method of repairing automobile bumpers. The method includes providing a steel shank of substantially rectangular cross-section, wherein the steel shank comprises a hooked end and an aperture. Also provided in this method is providing a lever bar dimensioned to pass through the aperture of the shank. An operator engages a portion of a bumper by the hooked end of the shank and places the lever bar through the aperture. Using a wall of the aperture as a fulcrum, by rotatably and pivotally exerting a force on the lever bar, a force on the bumper is then applied so that it is straightened or pulled into a desired position.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE DRAWINGS

Figure 1:
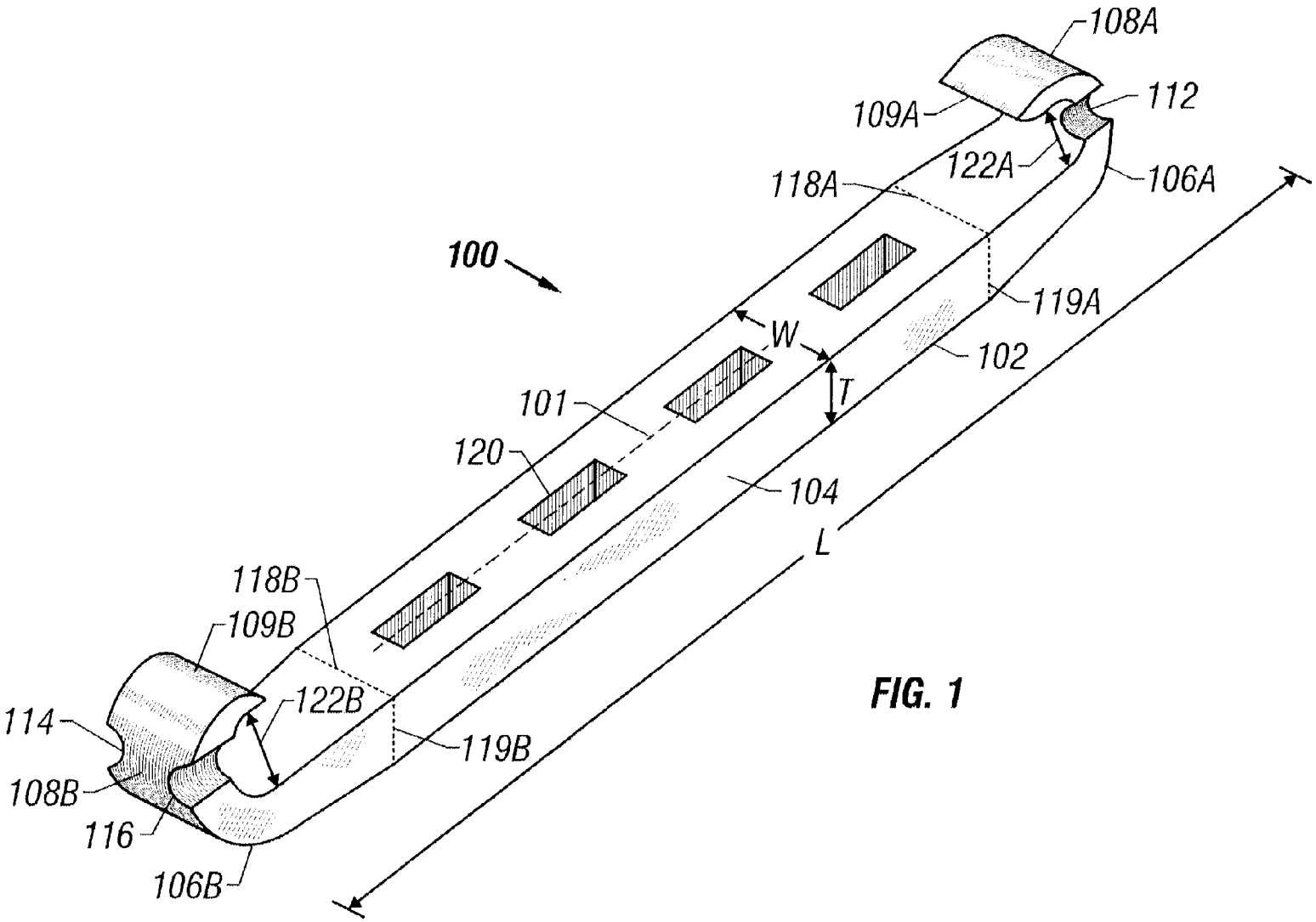
FIG. 1 depicts a perspective view of a bumper repair tool provided in accordance with the teachings of the present invention.

In the drawings, like or similar elements are designated with identical reference numerals throughout the several views, and the various elements depicted are not necessarily drawn to scale. Referring now to FIG. 1, depicted therein is a perspective view of a presently preferred exemplary embodiment of a bumper repair tool 100, hereinafter "hook bar," provided in accordance with the teachings of the present invention. A shank 102 of suitable length, and preferably of substantially rectangular cross-section and formed from a suitable grade of steel (for example, spring steel) comprises a major portion of the hook bar 100. The shank 102 is preferably provided with a first hook end 108A and a second hook end 108B, each of which hook ends tapers to a thin edge, 109A and 109B, respectively. The thin edges are adapted for being positioned, by way of prying, underneath a sheet metal surface, such as a bumper surface, that may be closely held against a solid part.

In the presently preferred exemplary embodiment, the shank 102 is approximately 25 inches in length (labeled as "L" and measured along a longitudinal axis 101 of the hook bar 100) and essentially straight, but preferably tapers slightly toward the hook ends 108A and 108B, forming a first neck 106A and a second neck 106B, respectively. The thickness (labeled as "T") of the shank 102 is about 0.5 inch in a middle portion 104, whereas it tapers to about 0.25 inch near the necks. The width (labeled as "W") of the shank 102 is preferably about 2.5 inches at the middle portion 104, although it tapers slightly towards the necks. Preferably, the tapering in thickness starts from taper lines 118A and 118B at the necks 106A and 106B, respectively. In addition, the tapering in width starts from taper lines 119A and 119B at the necks 106A and 106B, respectively.

The hook ends 108A and 108B are curved approximately 180° with different radii of curvature with respect to the necks 106A and 106B such that the thin edges 109A and 109B are disposed over the body of the shank 102 with different gaps. For example, with respect to the hook end 108A, a gap 122A between the thin edge 109A and the neck 106A is shown. Similarly, a gap 122B is shown between the thin edge 109B and the neck 106B at the hook end 108B. The gap 122A is preferably provided to be smaller than the gap 122B, so that different bumper styles may be accommodated, both in terms of models as well as with respect to whether the bumper is a front-end bumper or a rear-end bumper.

In accordance with the teachings of the present invention, a pair of opposing notches or indentations are provided at the curvature of the necks, one on each side of the neck. For example, notches 110 and 112 are provided at the curvature of the neck 106A. Similarly, notches 114 and 116 are provided at the curvature of the neck 106B. The notches are provided as part of the hook bar 100 of the present invention in order to maximize the contact surface between the hook end and the bumper surface when the hook bar is engaged. Further, while the contact surface is maximized, thereby increasing the amount of force available for pulling or straightening the bumper, the notches also reduce the probability of tearing or scratching of the bumper material.

Continuing to refer to FIG. 1, one or more apertures or holes, for example, aperture 120, are provided in the body of the shank 102. Preferably, the apertures are substantially square in shape and are about 1.5 inches per side. These apertures are preferably substantially aligned or centered with the longitudinal axis 101 of the hook bar 100. As will be described in greater detail hereinbelow, the apertures operate as fulcrum points with different lengths for applying a force when a bar of sufficient length is engaged therethrough.

Figure 2A:
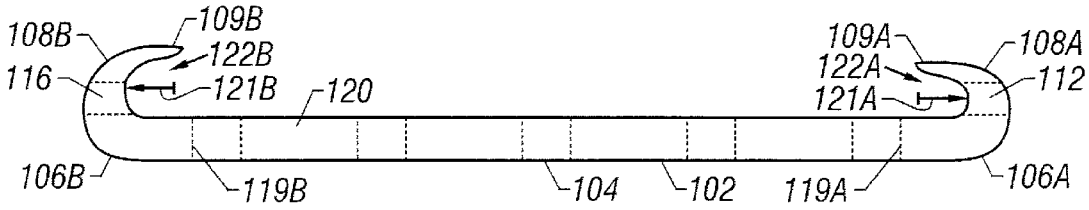
FIGS. 2A–2C depict front, plan (top) and end views, respectively, of the bumper repair tool provided in accordance with the teachings of the present invention.
Figure 2B:
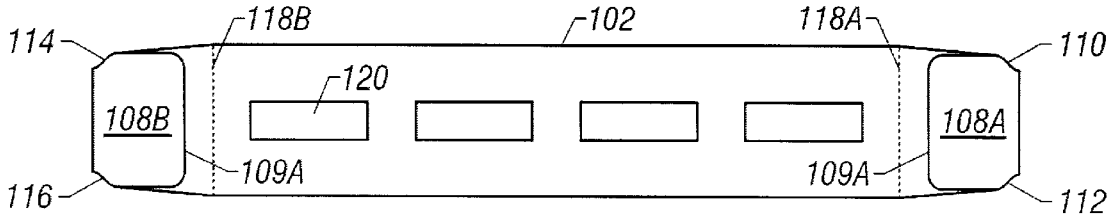
Figure 2C:
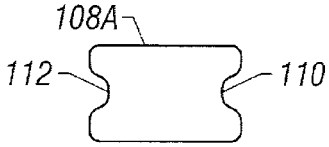

Referring now to FIGS. 2A through 2C, depicted therein are front, plan (top) and end views, respectively, of the hook bar 100. The different sizes of the gaps 122A and 122B between the thin edges and the corresponding necks are more clearly shown in the front view of the hook bar 100. The larger gap 122B is achieved by having a radius of curvature 121 B that is larger than a radius of curvature 121 A associated with the gap 122A. Also, the tapering of the shank 102, both in thickness and in width, is better depicted in these views. One of the end views, corresponding to the hook end 108A, is shown in FIG. 2C, wherein the notches 112 and 110 are more clearly shown.

Figure 3:
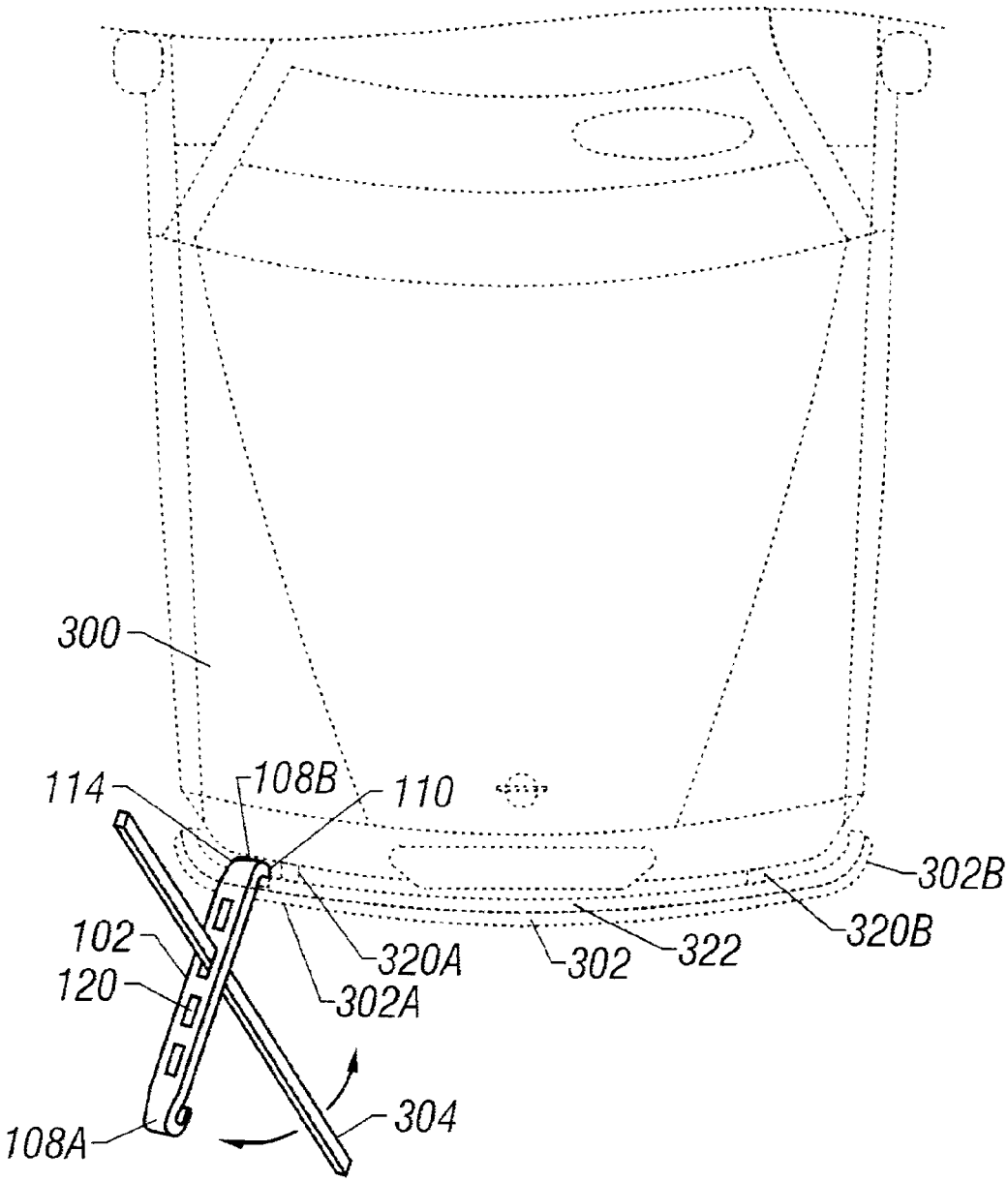
FIG. 3 illustrates a typical use of the bumper repair tool for straightening or realigning a bumper.

Referring now to FIG. 3, an illustration is provided therein for exemplifying a typical use of the hook bar tool 100 for straightening or repositioning a bumper 302 of a vehicle 300. The bumper 302 may be a rear-end bumper or front-end bumper of the vehicle 300, to which it is attached by suitable bumper couplings 320A and 320B. For illustrative purposes, a minor collision has caused the bumper 302 to be rotated, with the top 322 of the bumper being pushed towards the body of the vehicle 300. Accordingly, to repair the bumper 302, the top surface 322 needs to be pulled away from the vehicle 300, and the bumper 302 be rotated back to its original position.

For illustrative purposes, again, the hook end 108B of the hook bar 102 is engaged with a surface of the bumper end 302A. Those of ordinary skill shall realize upon reference hereto that either the top or bottom surfaces of the bumper end 302A may be engaged, depending upon the circumstances. A lever bar 304 of sufficient length (for example, between about 3.5 and 5 feet) and dimensioned to snugly pass through an aperture of the hook bar 102, is provided to increase the leverage a human operator may obtain by using manual means alone.

After snugly engaging the bumper surface with the hook end 108B of the hook bar 102, the lever bar 304 is placed through one of the apertures thereof. Exactly which aperture is appropriate may be determined by trial and error depending upon the bumper style and type, stature/strength of the human operator, length of the lever and hook bars, et cetera. Once the lever bar 304 is engaged in an aperture, by pivotally rotating it towards the vehicle or away from the vehicle, or in any other orientation, sufficient force is applied at the bumper end 302A so as to reposition it relative to the vehicle 300. A wall of the aperture through which the lever bar is engaged acts as a fulcrum or pivot for this rotational force. In this manner, a bumper that is pulled away from, or pushed up against the vehicle for some reason, may be repositioned relatively accurately and economically.

Although the system and method of the present invention have been described in particular reference to a hook bar with four square apertures, it should be realized upon reference hereto that the innovative teachings contained herein are not necessarily limited thereto and may be implemented advantageously with any number of apertures with a variety of shapes. Also, the hook ends may be provided to be curved in opposite directions, that is, one hook end may be curved up and the other may be curved down. In some embodiments, the thin edges of the hook ends, adapted to pry under a bumper surface, may include serrations, notches and the like. In some instances, only one hook end may be provided with the shank which may be made of any material having sufficient strength. Moreover, the various dimensions and taperings of the hook bar disclosed herein are amenable to numerous modifications, rearrangements, substitutions and other adjustments.

In addition, it should be apparent that no limitation on the lever bar construction is contemplated herein. Virtually any suitable material may be used for this purpose. Also, by increasing the length of the hook bar, it is possible to exert enough force on a work surface, thereby avoiding the use of a level bar. While the hook bar provided in accordance with the teachings of the present invention is advantageous in repairing bumpers, it should be appreciated that the hook bar tool may also be used for other sheet metal work.

It is believed that the operation and construction of the present invention will be apparent from the foregoing description. While the method and system shown and described have been characterized as being preferred, it will be readily apparent that various changes and modifications could be made therein without departing from the scope of the invention as defined by the claims set forth hereinbelow.

What is claimed is:

1. A bumper repair tool operable with a lever bar, comprising:

a shank with a first hook end and a second hook end, and a plurality of apertures formed along a longitudinal axis of said shank, said apertures being dimensioned to receive and allow passage of said lever bar therethrough;

said shank comprising a stiff material formed in a substantially rectangular cross-section with a thickness and a width, and having a taper in said thickness and said width at said first hook end and at said second hook end, thereby forming a first neck and a second neck thereat, respectively;

said first hook end tapering to a first thin edge curving over said first neck at a first radius of curvature, said second hook end tapering to a second thin edge curving over said second neck at a second radius of curvature, said first and second thin edges adapted for prying under a bumper surface such that one of the said first and second hook ends is removably and pivotally engagable at said bumper surface;

said first hook end having a pair of opposing notches formed thereat, one of said notches being disposed on a first side of said first hook end and another notch being disposed on a second side of said first hook end; and said second hook end having a pair of opposing notches formed thereat, one of said notches being disposed on a first side of said second hook end and another notch being disposed on a second side of said second hook end.

2. The bumper repair tool as set forth in claim 1, wherein said shank comprises spring steel and is approximately 25 inches long.

3. The bumper repair tool as set forth in claim 1, wherein said shank comprises spring steel is approximately 0.5 inch thick.

4. The bumper repair tool as set forth in claim 1, wherein said shank comprises spring steel is approximately 2.5 inches wide.

5. The bumper repair tool as set forth in claim 1, wherein said first and second hook ends are curved in opposite directions.

6. The bumper repair tool as set forth in claim 1, wherein said first and second radii of curvature are unequal.

7. The bumper repair tool as set forth in claim 1, wherein said first and second radii of curvature are equal.

8. The bumper repair tool as set forth in claim 1, wherein said plurality of apertures comprises four substantially square apertures.

9. The bumper repair tool as set forth in claim 1, wherein said plurality of apertures comprises five substantially square apertures.

10. The bumper repair tool as set forth in claim 1, wherein said plurality of apertures comprises one or more polygonally shaped apertures.

* * * * *